US006003465A

United States Patent [19]

Khachatrian et al.

[11] Patent Number: 6,003,465

[45] Date of Patent: Dec. 21, 1999

[54] LOWER PART OF THE HULL OF A PLANING AMPHIBIAN

[75] Inventors: Robert Khachatrian; Ashot Khachatrian, both of Glendale, Calif.; Vadim B. Voiloshnikov, Novosibirks, Russian Federation

[73] Assignee: MedTech Center, Inc., Glendale, Calif.

[21] Appl. No.: 09/038,456

[22] Filed: Mar. 11, 1998

[51] Int. Cl.[6] ..... B63B 1/00; B63B 1/22; B63B 17/00

[52] U.S. Cl. ..... 114/271; 114/284; 114/361; 114/61.25

[58] Field of Search ..... 114/271, 284, 114/287, 61.25, 61.32, 62, 357, 65 R, 361, 67 R; 441/40

[56] References Cited

U.S. PATENT DOCUMENTS

| | | | |
|---|---|---|---|
| 2,265,206 | 12/1941 | Stampfl | 114/271 |
| 3,056,980 | 10/1962 | Holladay | 114/357 |
| 3,413,948 | 12/1968 | Coll | 114/271 |
| 3,496,899 | 2/1970 | Weber | 114/271 |
| 3,559,222 | 2/1971 | Walker | 114/271 |
| 5,732,650 | 3/1998 | Peterson | 114/345 |

*Primary Examiner*—D. Glenn Dayoan
*Assistant Examiner*—Patrick Craig Muldoon
*Attorney, Agent, or Firm*—Knobbe Martens Olson & Bear, LLP.

[57] ABSTRACT

An improved design for the lower part of the hull of a planing amphibian. The design contains an immovable member, a dampening movable member in the form of a set of overlapping plates attached to the immovable member by the length of the front edge, and air balloons placed in between the movable and immovable members. There is also a flexible coupler attached to the longitudinal edges of the immovable and movable members permitting elastic bending of the plates. The plates forming the movable member are made of a nonwettable, elastic material, allowing elastic deformation of the movable member when the amphibian encounters land obstacles. The air balloons help to dampen the deformations. When operating on rough water, the plates forming the movable member elastically deform and compress the air balloons, decreasing the loads on the lower part of the hull. When the amphibian returns to land, the plates elastically deform and impact one another, shaking off any adhering ice. The pressure in the air balloons varies depending on the type of surface on which the amphibian is travelling. High pressures of 0.2–0.3 atmospheres are used when traveling on water or soft surfaces and low pressures of 0.05–0.08 atmospheres when moving on hard surfaces such as ice or snow. This insures minimal resistance when moving on water and minimal overloads when moving on hard surfaces. When operating mainly on water, the outer balloons can be inflated to a higher pressure than the other balloons, giving the lower part of the hull a "seagull wing" shape, increasing the stability of the amphibian.

9 Claims, 1 Drawing Sheet

A-A

LOWER PART OF THE HULL OF A PLANING AMPHIBIAN

FIELD OF THE INVENTION

The present invention is related to shipbuilding and concerns the design of the lower part of the hull of a planing amphibian watercraft, including an immovable member, a dampened movable member in the form of a set of plates, and elastic air balloons between the movable and immovable members of the lower part of the hull. The air balloons and the movable member of the lower part of the hull are installed on the whole surface of the immovable member. The plates are formed from an elastic, flexible material having the feature of non-wettability. The plates forming the movable member of the lower part of the hull have dimensions corresponding to the entire width of the lower surface and are installed in such a way that they overlap one another along the whole length of the lower part of the hull. The casing of the planing amphibian is supplied with an air distribution system for changing the air pressure in all or several air balloons, depending on the operating conditions.

BACKGROUND OF THE INVENTION

The invention is related to shipbuilding and concerns the design of the lower part of the hull of a planing amphibian.

It is known that the lower part of the hull of a planing amphibian can be built to be flat, smooth and stiff (Pat. of France No. 2490178, Int. Cl. B63B,1/18,1982). The lower part of the hull of this invention doesn't allow for the dampening of impacts from the sea-ways or while clearing obstacles on land. The resulting deformations cause great stress along the lengthwise axis of the lower part of the hull and may lead to damage of the lower part of the hull. Besides, the potential for impact of the lower part of the hull with land requires it to be reinforced, hence, to be heavy. The stiffness of the lower part of the hull allows earth and snow to stick to it. The snow becomes ice, thereby making the movement of the amphibian on land very difficult. All of these factors decrease the operational characteristics of the planing amphibian.

The lower part of the hull most similar in the technical sense and in operation to the present invention is the lower part of the hull of the planing amphibian described in the SU Certificate No. 759390, Int.Cl. B63B,1/22, B60 F, 3/00, 1976. The lower part of the hull according to that invention contains a dampened movable hull member symmetrical to the center plane and attached by its front cross-sectional edge to an immovable member, permitting rotation relative to the hinge. Moreover, between the immovable and movable members of the lower part of the hull, there are air vessels which communicate with an air system. The movable member of the lower part of the hull forms a series of movable steps in cross section and is connected flush with the contours of the immovable member. The movable member of the lower part of the hull is a V-shaped plate in cross-section, and the immovable member of the lower part of the hull has a transverse step, to which the transverse hinge for rotating the movable member of the lower part of the hull is attached—the transverse hinge is in the form of an elastic beam which is situated along the front edge of the movable member. The ship-borne borders of the movable member form a longitudinal step.

The deficiency of this lower part of the hull lies in its insufficient dampening features—there may be severe overloads when the amphibian moves over land obstacles. This is the result of placing the dampening member and air vessels on only a part of the immovable external surface. That is why this surface, excluding the protected part, contacts the ground in the stern while going over obstacles. This deficiency requires that the immovable member be strengthened and hence, leads to greater weight. The stress on the lower part of the hull is accentuated by the contact of the hinge with the air system and the construction of the movable member as a V-shaped plate in cross section, increasing the stress along the bend line and requiring strengthening of the V-shaped plate. The demands for structural strength for both the movable and immovable members requires that they be stiff and metallic, and hence, have good wettability. This leads to snow sticking to the lower part of the hull and ice forming on the lower part of the hull after the amphibian moves from water to land, as well as during the stopping of the amphibian after its moving on the land on account of the heating of the lower part due to friction—this makes worse the amphibian's motion qualities, causing the overloading of the motor. In addition, the hinge fastening the front edge of the movable member to the immovable member of the lower part of the hull leads to a longitudinal step, which, when sliding on land or when making a sharp turn, may cause the amphibian to turn over. The stability is impaired.

In addition, the pressure in the air balloon is constant and does not change during the various operations.

There is a need for a better design of the lower part of the hull for a planing amphibian to maximize the performance of the amphibian.

The object of the present invention is to improve the operational features of the amphibian by improving the dampening characteristics of the lower part of the hull, lowering its weight, increasing the stability, and facilitating the movement of the amphibian from a swampy surface to land, and minimizing the amount of freezing on the lower part of the hull.

SUMMARY OF THE INVENTION

The technical object of our invention will be achieved as follows: the lower part of the amphibian hull, comprising an immovable member; a dampening movable member in the form of a plate fastened to the immovable member of the lower part of the hull by the length of its front edge; and resilient air balloons placed between the immovable and the movable members of the lower part of the hull. The air balloons and the movable member of the lower part of the hull are installed along the entire surface of the immovable member of the lower part of the hull, and the movable member of the lower part of the hull is made of a flexible, elastic material which has the feature of non-wettability. The movable member is fastened to the immovable member along its longitudinal edges with a flexible coupler permitting elastic bending along the longitudinal edges. The movable part of the hull is formed from plates with dimensions equal to the width of the hull surface and installed to overlap one another along the whole length of the lower part of the hull.

The flexible coupler is an elastic strip which bends longitudinally and is fastened tightly to the immovable member of the lower part of the hull along one edge and to the movable member on the other edge, thereby permitting the movement of the movable member of the lower part of the hull. The immovable member of the lower part of the hull is thereby joined with the movable one.

Solely during operation of the amphibian on the water, the edge of the joining strip envelopes the extreme air balloons and may be fixed to the external surface of the immovable member of the lower part of the hull.

The installation of the air balloons and the movable member along the entire surface of the immovable member means that only the movable member of the lower part of the hull contacts the ground. The flexibility and elasticity of the movable member, and the fastening of the movable member to the immovable member through the flexible couplers permit the elastic deformation of the movable member relative to the immovable member when it encounters land obstacles. In addition to these features of the movable member, the air balloons also dampen these deformations. All of these factors allow the immovable member to be light in weight, as well as raising the dampening ability of the lower part of the hull and lowering the hull vibration.

The flexibility and light weight of the movable member, construction from non-wettable material, and the design innovations concerning the fastening of the movable member to the immovable member all help to shake off ice from the lower part of the hull after the amphibian moves from water to land, without the need to change the pressure in the air balloons and without using the air system at the expense of elastic deformation of the movable member. The vibration and minimal adhesion with ice also allow decreasing the weight of the amphibian as a whole. The construction of the movable member as a set of overlapping plates installed along the entire length of the amphibian makes it possible to dampen the impacts with land obstacles by each plate separately, decreasing the amount of transmittal along the axis of the lower part of the hull. After the amphibian moves from water to land, the plates, by impacting against one another, improve the ability of the movable member to shake off the snow sticking to the lower part of the hull.

Fastening the longitudinal edge of the movable member to the immovable member of the lower part of the hull with a bend, where the radius of the bend equals the radius of the air balloon, as well as the flexible coupler and the elastic strip joining the hull members permits the amphibian to turn sharply on land and to slide without turning-over. Moreover, on the water, the movable member, due to its flexibility under the action of the distributed load, which will exert less force on the borders of the movable member due to the bending, will be bent inside in its middle section acquiring the features of a multi-hull vessel. This allows increased stability of the lower part of the hull on the land without worsening its stability on the water.

In addition, the coupling of the strip with the movable and immovable members of the hull when enveloping the extreme air balloons by the strip edges allows the movable part to be bent to profile the lower part of the hull in the form of a "seagull wing." The amphibian in such case acquires the features of a multi-hull vessel; it also raises the stability of the amphibian on the water.

Thus, the design of the amphibian hull allows the performance of the planing amphibian to be improved.

SHORT DESCRIPTION OF DRAWINGS

DETAILED DESCRIPTION OF THE INVENTION

Figure 3:
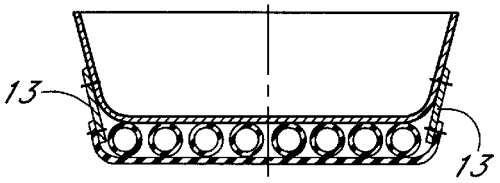
FIG. 3 is a sectional view along Section A—A of FIG. 2.

The movable member 1 of the lower part of the hull is made from a flexible, elastic, non-wettable material, for example, glass-reinforced plastic, and is installed along the entire surface of the immovable member 2. The flexible air balloons 3 and 4 are situated between the movable (1) and immovable (2) members of the lower part of the hull along the hull surface. The movable member 1 may be formed of one or a set of plates 5,6 with dimensions equal to the entire width of the external surface; the plates are installed to overlap one another along the entire length of the lower part of the hull, thereby building movable cross-section ledges 7. The plate 5 is firmly fixed by its cross sectional front edge 8 to the bow surface of the immovable member of the lower part of the hull. The longitudinal borders of plates 5,6 are connected to the immovable member 2 by means of a flexible coupler in the form of an elastic strip 10 formed, for example, from multi-layer rubber-cloth material. The strip 10 is bent longitudinally and stiffly secured by its edges 11 and 12 with, for instance, a bolt joint 13, to the immovable member 2 by edge 11 and to the longitudinal border 9 of the movable member 1 by edge 12. The edges 11 and 12 of the strip 10 are fastened tightly, building an elastic bend on the longitudinal borders 9 of the movable member. The strip 10 therefore integrates the movable and immovable members of the lower part of the hull (FIG. 3).

When the amphibian is operated mainly on water, for example, in summer, it is possible to fix the edge 12 of the strip 10 to the external surface of the immovable member 2 thereby enveloping the extreme air balloons with the edge 12 of strip 10.

Description of Operation

The planing amphibian with the lower part of the hull according to the present invention is operated as follows.

Figure 1:
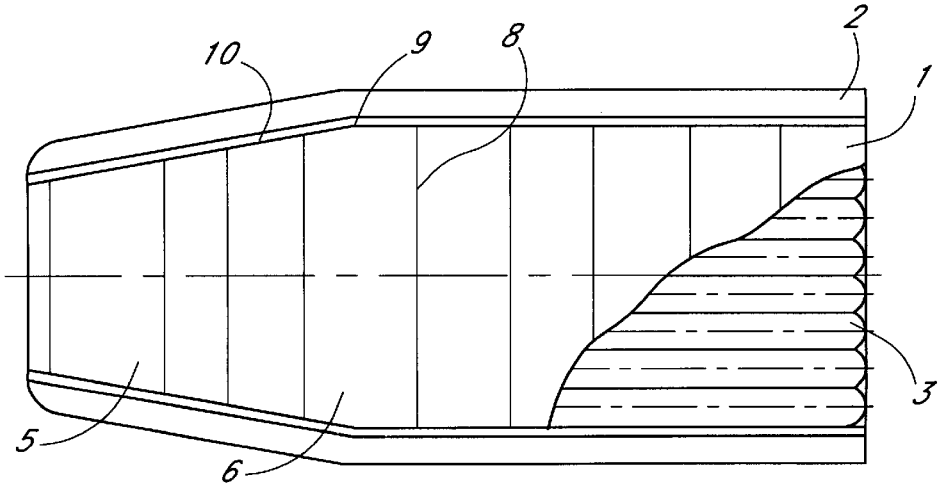
FIG. 1 is a schematic view of the lower part of the amphibian hull as viewed from below.
Figure 2:
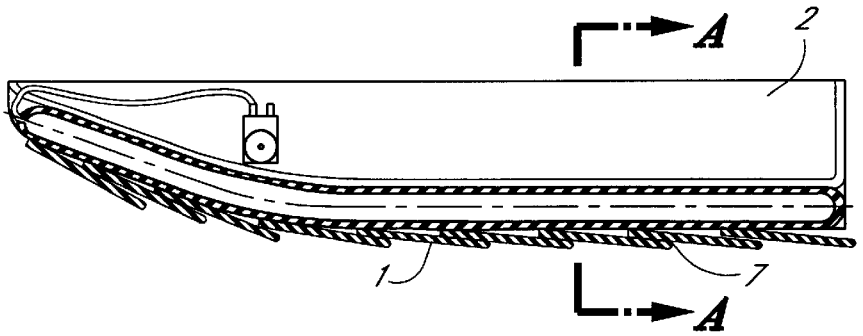
FIG. 2 is a longitudinal section of the lower part of the hull on the center plane.
Figure 4:
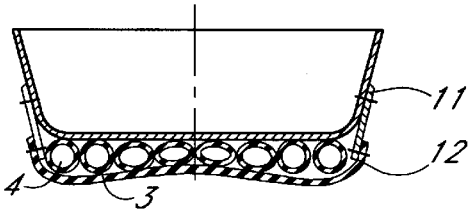
FIG. 4 is a sectional view along Section A—A of FIG. 2, when the amphibian is moving on the water.

When the amphibian is operated on rough water, the plates 5 and 6 of the movable member 1 elastically deform under the action of the impact and move relative to the immovable member 2, thereby changing the tension of the elastic strip 10 and compressing the air balloons 3 and 4. Thus, the loads exerted on the lower part of the hull decrease, and the plates 5 and 6 of the movable member 1 can bend inward in the middle (FIG. 4), acquiring the features of a multi-hull vessel. The cross-section movable ledges 7 take the function of steps, building inter-step zones which are free of hydrodynamic resistance.

When the amphibian returns to land, the water rolls down from the plates 5 and 6 of the movable member 1, the plates elastically deform, each separately, impacting each other and shaking off any adhering ice. Moreover, the amphibian is prevented from sliding backwards (when ascending a steep grade, for example) by the cross-section ledges 7.

When clearing obstacles on land, each plate deforms elastically and moves, thereby changing the form of the bend of strip 10, compressing the air balloons and dampening the loads which are perceived by the lower part of the hull as a whole.

When the amphibian moves on various surfaces, the pressure in the air balloons changes through the air distribution system: when moving on water and soft surfaces, the pressure reaches 0.2–0.3 atmosphere; when moving on hard surfaces such as ice or snow, etc., the pressure decreases to 0.05–0.08 atmosphere. This operation insures minimal resistance when moving on water and minimal overloads when moving on hard surfaces.

When moving the amphibian onto land after traveling on swampy ground or to break off frozen ice from the lower part of the hull, it is enough to give the hull the required vibration by loading or swaying the rudder. This will cause an elastic deformation of the movable member 1 of the lower part of the hull.

When turning sharply or when sliding on snow, the amphibian slides on the elastic bent longitudinal borders 9 and the front cross-section edge 8 of the movable member 1, thereby maintaining stability.

Figure 5:
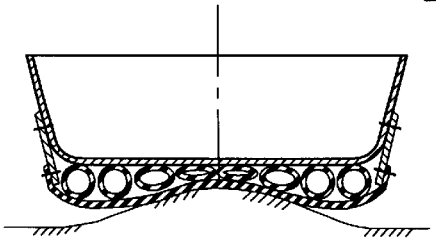
FIG. 5 is a sectional view along Section A—A of FIG. 2 (the strip is fastened during the enveloping of the extreme air balloons, for example, while clearing land obstacles along the amphibian axis).

When operating the amphibian mainly on water, for instance, in summer, the variant of fastening the flexible coupler according to FIG. 5 is preferable. In this case, the extreme air balloons must be inflated to a pressure much higher than the air balloons 3 until the middle part of the movable member 1 is concave, and the lower part of the hull takes the profile of the "seagull wing". The amphibian acquires in this case the features of a multi-hull vessel, which will increase the stability of the planing amphibian.

What we claim:

1. A lower part of the hull of a planing amphibian, comprising:

an immovable member;

a dampening movable member comprising a plurality of plates, each plate having a front edge two side edges and a rear edge, wherein each plate of said dampening movable member is fastened to said immovable member by corner areas defined by intersections of said front edge with said side edges; and a plurality of elastic air balloons, wherein said elastic air balloons are placed between said immovable member and said dampening movable member.

2. The lower part of the hull of claim 1, wherein said air balloons and said dampening movable member are placed on the entire surface of said immovable member.

3. The lower part of the hull of claim 1, additionally comprising an air distribution system connecting said air balloons, wherein said air distribution system maintains necessary pressure in said air balloons in various operating conditions.

4. The lower part of the hull of claim 1, wherein said dampening movable member is flexible and elastic and is made of a material which is non-wettable.

5. The lower part of the hull of claim 1, additionally comprising two couplers, each having two longitudinal edges, wherein a first longitudinal edge of a first coupler is attached to one of said two side edges of each of said plurality of plates, wherein the other of said two side edges of said first coupler is attached to said immovable member, wherein a first longitudinal edge of a second coupler is attached to a second longitudinal edge of each of said plurality of plates, wherein a second longitudinal edge of said second coupler is attached to said immovable member, and wherein said first and second couplers can form an elastic bend.

6. The lower part of the hull of claim 1, wherein the width of said plurality of plates comprising said dampening movable member is equal to the width of the external surface.

7. The lower part of the hull of claim 1, wherein said plurality of plates are installed to overlap one another along the entire length of said immovable member.

8. The lower part of the hull of claim 5, wherein said first coupler and said second coupler are formed from elastic strips.

9. The lower part of the hull of claim 5, wherein said first coupler and said second coupler are longitudinally bent and are fastened tightly by their edges to the immovable member of the lower part of the hull.

* * * * *